United States Patent [19]

Chuang

[11] Patent Number: 4,578,830

[45] Date of Patent: Apr. 1, 1986

[54] LIFTING DEVICE FOR STOOL COVER

[76] Inventor: Wei-Chih Chuang, 8, Lane 69, Hsin Hai Road, Sec. 7, Taipei, Taiwan

[21] Appl. No.: 702,305

[22] Filed: Feb. 15, 1985

[51] Int. Cl.[4] ..... A47K 13/10

[52] U.S. Cl. ..... 4/251; 4/236

[58] Field of Search ..... 4/251, 234, 236

[56] References Cited

U.S. PATENT DOCUMENTS

| | | | |
|---|---|---|---|
| 2,042,276 | 5/1936 | Revers | 4/251 |
| 2,712,654 | 7/1955 | Batlas et al. | 4/251 |
| 3,316,561 | 5/1967 | Newkirk | 4/251 |

FOREIGN PATENT DOCUMENTS

| | | | |
|---|---|---|---|
| 2382223 | 3/1977 | France | 4/251 |
| 625123 | 9/1961 | Italy | 4/251 |

*Primary Examiner*—Stephen Marcus
*Assistant Examiner*—Linda J. Sholl
*Attorney, Agent, or Firm*—Bacon & Thomas

[57] ABSTRACT

The present invention relates to a lifting device for stool cover, and in particular to one comprising a bracket having a lug at one end and a supporting portion at the other end, an upper rack slidably fitted with the upper part of the supporting portion, a lower rack slidably fitted with the lower part of the supporting portion, an outer shaft inserted into the bracket, an inner shaft inserted into the outer shaft, a driving arm pivoted on the lower part of the supporting portion, a tubular member secured to the lower part of the driving arm, a controlling lever fixedly connected with the tubular member at the lower end, a stool lid having a square hole adapted to the outer shaft and a stool seat having a square hole adapted to the inner shaft.

1 Claim, 7 Drawing Figures

LIFTING DEVICE FOR STOOL COVER

BACKGROUND OF THE INVENTION

The present invention relates to a lifting device for stool cover.

Almost all stool covers used nowadays are operated by hand, that is, it is very inconvenient to use. Furthermore, the hand might be stained with sewage. Hence, many attempts have been made to eliminate such drawbacks, but none of them can lead to satisfactory results.

It is, therefore, an object of the present invention to provide a lifting device for stool cover which may obviate and mitigate the above-mentioned drawbacks.

SUMMARY

The present invention relates to a lifting device for stool cover which utilizes pinions in association with racks to control a stool cover.

It is the primary object of the present invention to provide a lifting device for stool cover which is simple in construction.

It is another object of the present invention to provide a lifting device for stool cover which is easy to use.

It is still another object of the present invention to provide a lifting device for stool cover which is economic to produce.

It is still another object of the present invention to provide a lifting device for stool cover which can be quickly assembled.

It is a further object of the present invention to provide a lifting device for stool cover which is facile to manufacture.

Other objects and merits and a fuller understanding of the present invention will be obtained by those having ordinary skill in the art when the following detailed description of the best mode contemplated for practicing the invention has been read in conjunction with the accompanying drawings wherein like numerals refer to like or similar parts and in which:

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
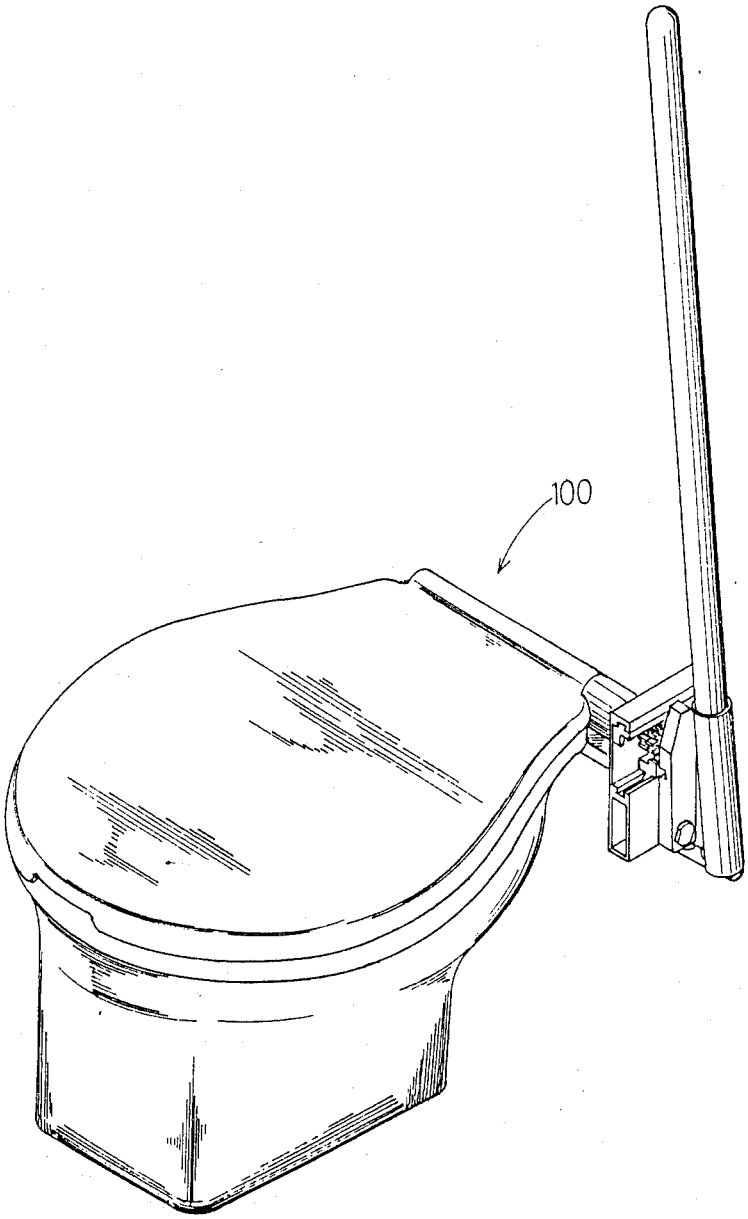
FIG. 1 shows an application of a lifting device for stool cover according to the present invention.
Figure 2:
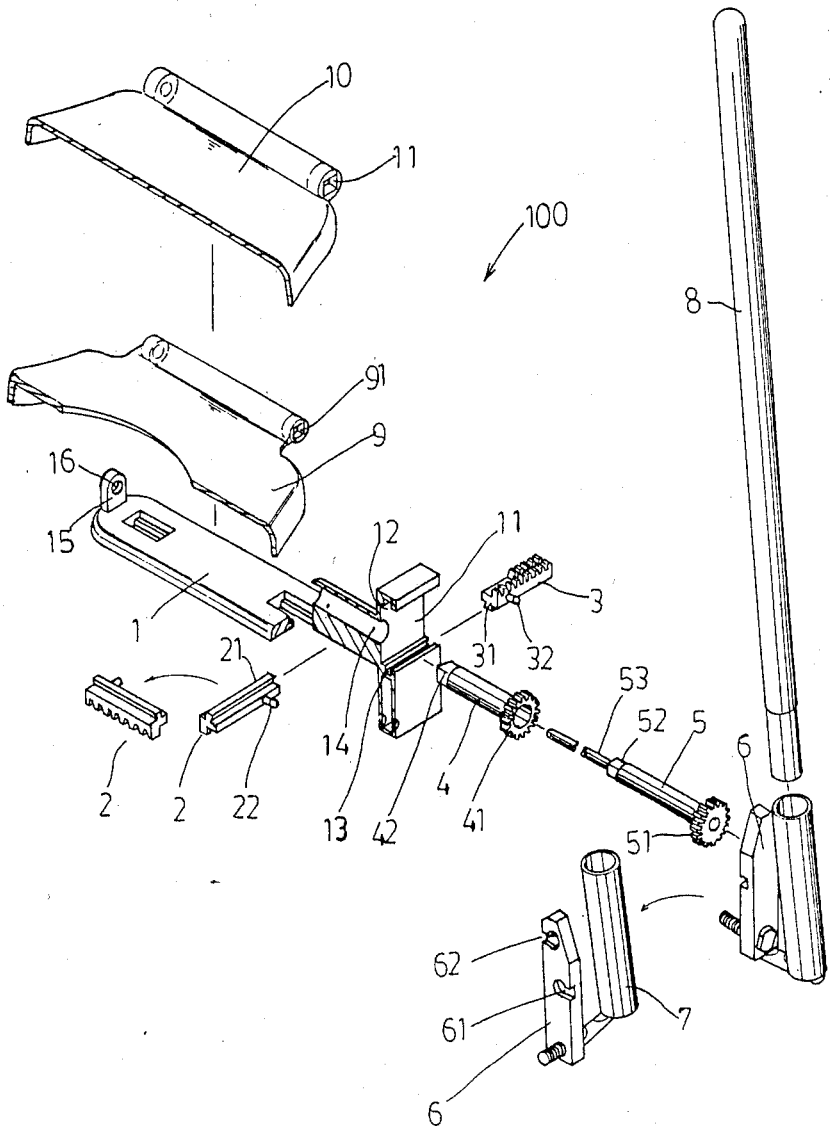
FIG. 2 is an exploded view of the lifting device.
Figure 7:
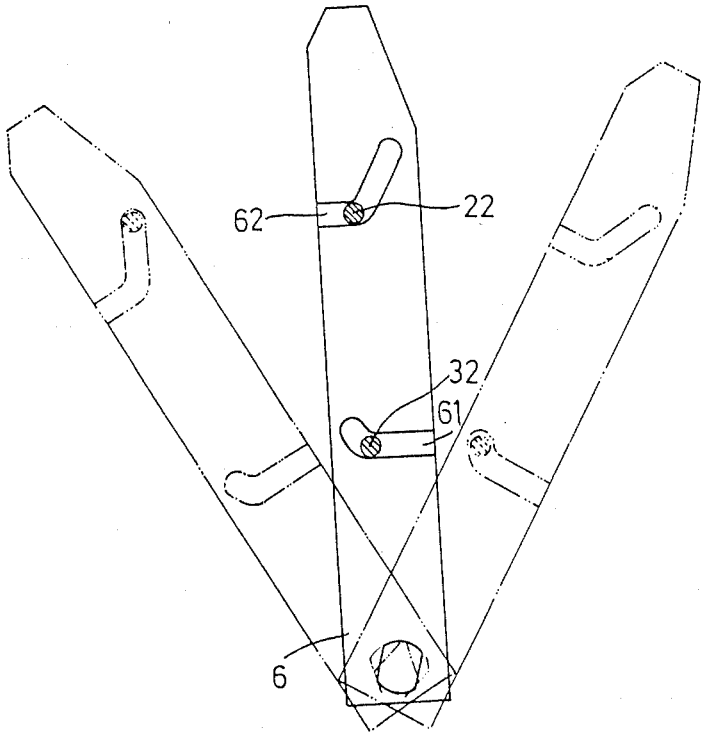
FIG. 7 shows the function of the driving arm.

Referring to the drawings and in particular to FIG. 2 thereof, the lifting device 100 according to the present invention comprises a bracket 1 which may be fastened on the bowl of a stool in known manner. The bracket 1 has a lug 15 at one end and a supporting portion 11 at the other end. The lug 15 is provided with a center hole 16. The supporting portion 11 has a hole 14 in alignment with the center hole 16 of the lug 15, an upper dovetail slot 12 and a lower dovetail slot 13. An upper rack 2 having a dovetail 21 on its top and a pin 22 extending outwardly from the outer side thereof is slidably fitted with the upper dovetail slot 12 of the supporting portion 11 of the bracket 1. The bottom of the upper rack 2 is longitudinally divided into two parts and only the inner one of the parts is provided with teeth. A lower rack 3 having a dovetail 31 on its bottom and a pin 22 extending outwardly from one side thereof is slidably fitted with the lower dovetail slot 13. The top of the lower rack 3 is longitudinally divided into two parts and only the outer part and one-half of the inner part are provided with teeth. An outer shaft 4 having a pinion 41 at one end and a square portion 42 at the other end is inserted into the hole 14 of the supporting portion 11 of the bracket 1, with the square portion 42 adapted to a square hole 11 of a stool lid 10. The outer shaft 4 is hollow in structure. Inserted into the outer shaft 4 is an inner shaft 5 having at one end a pinion 51 and at the other end a square portion 52 adapted to a square hole 91 of a stool seat 9. The inner shaft 5 further has an axle 53 extending through the center hole 16 of the lug 15 of the bracket 1. As a result, the stool lid 10 and the stool seat 9 will be rotated in unison with the outer shaft 4 and the inner shaft 5, respectfully. A driving arm 6 is pivoted on the lower part of the supporting portion 11 of the bracket 1 by means of a screw. The driving arm 6 is formed at one side with a first slot 61 adapted to the pin 32 of the lower rack 3 and at the other side with a second slot 62 adapted to the pin 22 of the upper rack 2. With reference to FIG. 7, when the driving arm 6 is turned clockwise from the normal position, the pin 32 of the lower rack 3 will engage with the first slot 61 of the driving arm 6 while the pin 22 of the upper rack 2 will disengage from the second slot 62, thereby pushing the lower rack 3 to the right. Similarly, when the driving arm 6 is turned counterclockwise from the normal position, the pin 32 of the lower rack 3 will disengage from the first slot 61 of the driving arm 6 while the pin 22 of the upper rack 2 will engage with the second slot 62 of the driving arm 61, thus pushing upper rack 3 to the left. A tubular member 7 is welded or otherwise secured to the lower part of the driving arm 6. A controlling lever 8 is fixedly connected with the tubular member 7 at its lower end. Hence the driving arm 6 will be rotated with the controlling lever 8.

Figure 3:
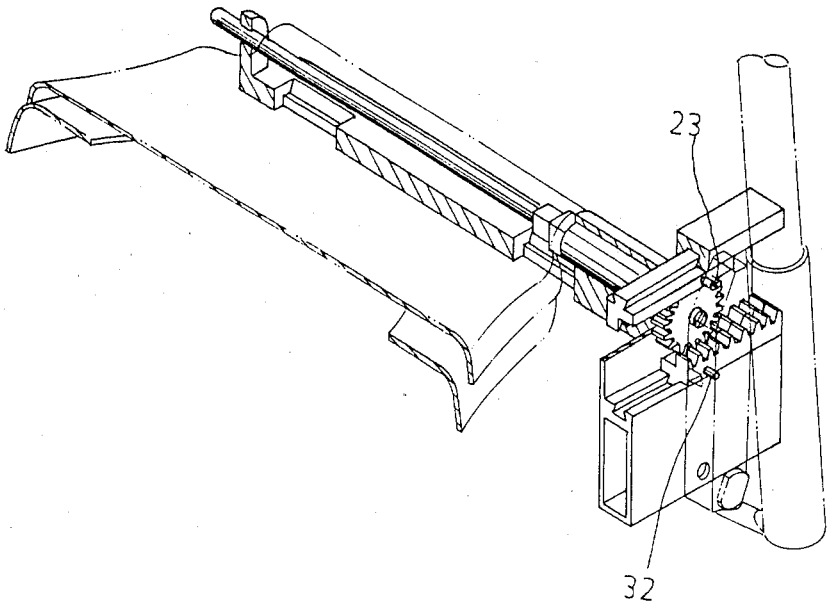
FIG. 3 shows the relative positions of the component parts of the lifting device when the stool lid is closed.

Turning to FIG. 3, there is shown the relative positions of the component parts of the lifting device according to the present invention. As can be seen, the upper rack 2 and the lower rack 3 are positioned so that the pin 22 of the upper rack 2 and the pin 32 of the lower rack 3 are respectfully located at the middle of the upper dovetail slot 12 and the lower dovetail slot 13 of the supporting portion 11 of the bracket 1.

Figure 4:
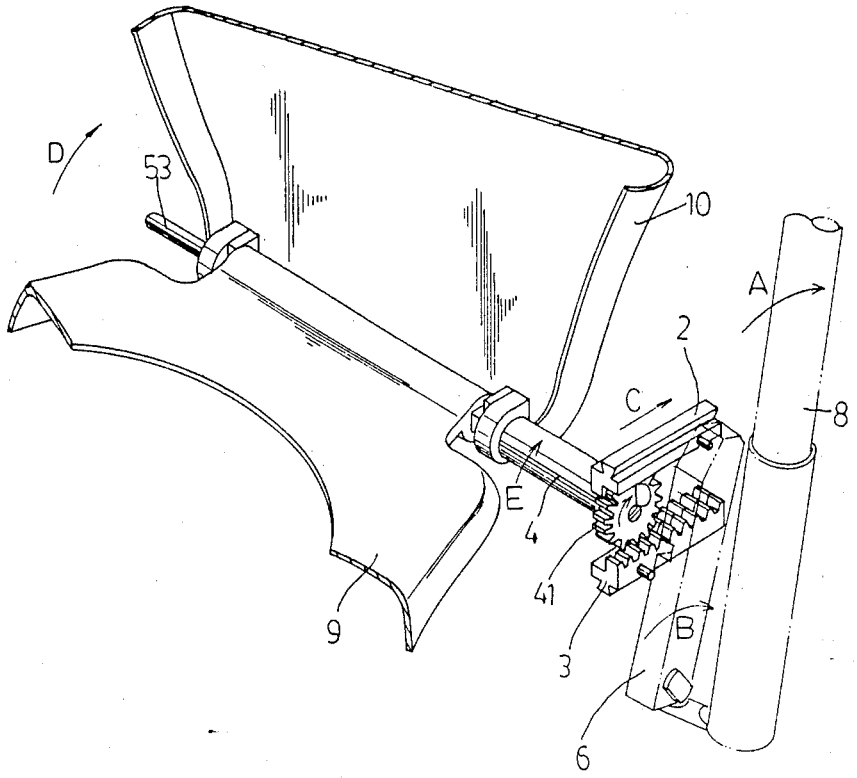
FIG. 4 shows how to open the stool lid of the lifting device.

Turning to FIG. 4, when the controlling lever 8 is pushed in the direction of arrow A, the driving arm 6 will be moved in the direction of arrow B. Then, the driving arm 6 will drive the upper rack 2 to move in the direction of arrow C, which in turn will rotate pinion 41 of the outer shaft 4 in the direction of arrow D. Consequently, the outer shaft 4 will raise the stool lid 10.

Meanwhile, the lower rack 3 and the inner shaft 5 remain stationary. Hence, it is only necessary to push the controlling lever 8 in the direction of arrow A to open the stool lid 10. When desired to close the stool lid 10, simply pull back the controlling lever 8 to its original position.

Figure 5:
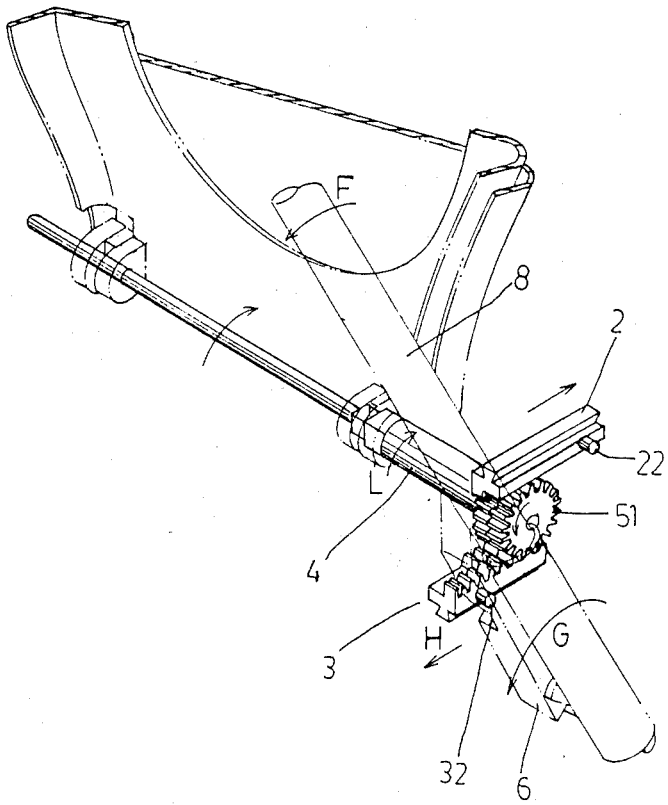
FIG. 5 shows how to open the stool seat of the lifting device.

Referring to FIG. 5, there is shown the way how the stool seat 9 is raised. As illustrated, when the controlling lever 8 is pulled in the direction of arrow F, the driving arm 6 will be moved in the direction of arrow G. Then, the driving arm 6 will carry the lower rack 3 to move in the direction of arrow H which in turn will rotate the pinion 51 of the inner shaft 5 and the pinion 41 of the outer shaft 4 thereby lifting the stool lid 10 and the stool seat 9. To close the stool lid 10 and the stool seat 9, simply push the controlling lever 8 back to its original position.

Figure 6:
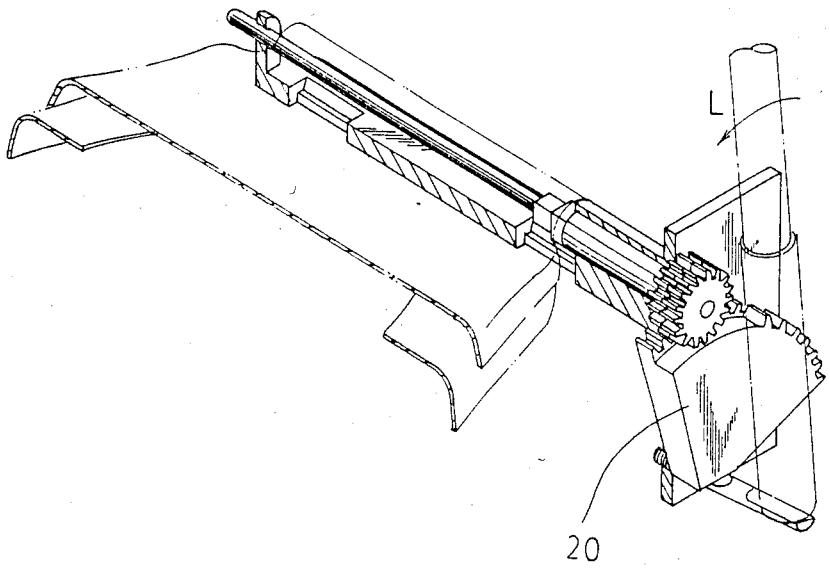
FIG. 6 shows another preferred embodiment of lifting device according to the present invention.

With reference to FIG. 6, there is shown another preferred embodiment of the present invention. As shown, the upper rack 2, the lower rack 3 and the driving arm 6 are replaced with a sector member 20. The top surface of the sector member 20 is divided into four parts and only two diagonally opposite parts are provided with teeth. When the controlling lever 8 is pulled to rotate the sector member 20 in the direction of arrow L, the pinion 41 of the outer shaft 4 will be rotated thereby lifting the stool lid 10. As the sector member 20 is further rotated in the direction of arrow L, the pinion 51 of the inner shaft 5 will be rotated to lift the stool seat 9. To lower the stool lid 10 and/or the stool seat 9, it is only necessary to push the controlling lever 8 in reverse direction.

Although this invention has been described with a certain degree of particularity, it is understood that the present disclosure is made by way of example only and that numerous changes in the detail of construction and the combination and arrangement of parts may be resorted to without departing the spirit and scope of the invention as hereinafter claimed.

I claim:

1. A lifting device for stool cover, comprising:

a bracket having a lug at one end and a supporting portion at the other end, said lug having a center hole, said supporting portion having a hole in alignment with the center hole of said lug, an upper dovetail slot, and a lower dovetail slot;

an upper rack slidably fitted with the upper dovetail slot of the supporting portion of said bracket, said upper rack having on its top a dovetail adapted to the upper dovetail slot of the supporting portion of said bracket, a pin extending outwardly from the outer side thereof, and a plurality of teeth longitudinally provided on the inner half of the bottom thereof;

a lower rack slidably fitted with the lower dovetail slot of the supporting portion of said bracket, said lower rack having on its bottom a dovetail adapted to the dovetail slot of the supporting portion of said bracket, and a pin extending outwardly from the outer side thereof, said lower rack being designed so that the top thereof is longitudinally divided into two parts and only the outer part and one-half of the inner part are provided with teeth;

an outer shaft inserted into the hole of the supporting portion of said bracket, said outer shaft being provided at one end with a pinion and at the other end with a square portion;

an inner shaft inserted in said outer shaft and rotatable with respect thereto, said inner shaft being provided with a pinion at one end, a square portion at the other end, and an axle extending therethrough;

a driving arm pivoted on the lower part of the supporting portion of said bracket, said driving block having at one side a first slot adapted to the pin of said upper rack and at the other side a second slot adapted to the pin of said lower rack;

a tubular member secured to the lower part of said driving arm;

a controlling lever fixedly connected with said driving arm at the lower end;

a stool lid having a square hole adapted to the square portion of said outer shaft; and a stool seat having a square hole adapted to the square portion of said inner shaft.

* * * * *